US011143986B1

(12) United States Patent
Takahashi

(10) Patent No.: US 11,143,986 B1
(45) Date of Patent: Oct. 12, 2021

(54) DEVELOPING DEVICE AND IMAGE FORMING APPARATUS

(71) Applicant: TOSHIBA TEC KABUSHIKI KAISHA, Tokyo (JP)

(72) Inventor: Nobuaki Takahashi, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/013,889

(22) Filed: Sep. 8, 2020

(51) Int. Cl.
*G03G 15/06* (2006.01)
*G03G 15/09* (2006.01)
*G03G 15/08* (2006.01)

(52) U.S. Cl.
CPC ..... *G03G 15/0928* (2013.01); *G03G 15/0889* (2013.01); *G03G 15/0896* (2013.01); *G03G 2215/0609* (2013.01)

(58) Field of Classification Search
CPC ..... G03G 15/0898; G03G 15/0921; G03G 15/0942; G03G 15/5025; G03G 15/5041; G03G 15/556; G03G 15/0889; G03G 15/0896; G03G 15/0928; G03G 2215/0609
See application file for complete search history.

(56) References Cited

U.S. PATENT DOCUMENTS 5,177,536 A 1/1993 Watanabe et al.
2015/0093139 A1* 4/2015 Kuramoto ..... G03G 15/0806 399/92
2019/0018336 A1 1/2019 Ogasawara et al.

* cited by examiner

*Primary Examiner* — Hoang X Ngo
(74) *Attorney, Agent, or Firm* — Amin, Turocy & Watson, LLP

(57) ABSTRACT

According to one embodiment, the developing device includes a developing case containing toner, a mixer configured to diffuse the toner in the developing case, and a developing roller configured to develop a latent image formed on an image carrier. The developing case includes a circulation path through which air containing the toner flows. The developing roller is partially exposed from the developing case. The developing roller includes a sleeve rotating along with the movement of the image carrier and a plurality of magnetic pole portions disposed inside the sleeve. The developing roller holds the toner on the sleeve and supplies the toner to the image carrier to develop the latent image. The developing device further includes a magnet disposed apart from the developing roller. The magnet faces one of the magnetic pole portions across the sleeve.

19 Claims, 6 Drawing Sheets

DEVELOPING DEVICE AND IMAGE FORMING APPARATUS

FIELD

Embodiments described herein relate generally to a developing device and an image forming apparatus.

BACKGROUND

An image forming apparatus such as a multi-function peripheral (MFP) or a printer is known. The image forming apparatus includes an image carrier on which a latent image is formed, a developing device configured to develop the latent image formed on the image carrier with toner, and a transfer device configured to transfer the image developed by the developing device to a recording medium. The developing device includes a developing roller that holds toner and supplies the toner to the image carrier.

DETAILED DESCRIPTION

In general, according to one embodiment, provided is a developing device configured to develop a latent image formed on an image carrier with toner. The developing device includes a developing case containing the toner and including a circulation path through which air containing the toner flows, a mixer accommodated in the developing case and configured to stir the toner to diffuse the toner in the developing case, and a developing roller partially exposed from the developing case and accommodated in the developing case. The developing roller includes a sleeve rotating along with movement of the image carrier and a plurality of magnetic pole portions disposed inside the sleeve. The developing roller holds the toner on the sleeve and supplies the toner to the image carrier to develop the latent image. The developing device further includes a magnet disposed apart from the developing roller. The magnet faces one of the magnetic pole portions across the sleeve.

An image forming apparatus according to one embodiment includes an image carrier on which a latent image is formed, a developing device configured to develop the latent image formed on the image carrier with toner, and a transfer device configured to transfer the image developed by the developing device to a recording medium. The developing device includes a developing case containing the toner and including a circulation path through which air containing the toner flows, a mixer accommodated in the developing case and configured to stir the toner to diffuse the toner in the developing case, and a developing roller partially exposed from the developing case and accommodated in the developing case. The developing roller includes a sleeve rotating along with movement of the image carrier and a plurality of magnetic pole portions disposed inside the sleeve. The developing roller holds the toner on the sleeve and supplies the toner to the image carrier to develop the latent image. The developing device further includes a magnet disposed apart from the developing roller. The magnet faces one of the magnetic pole portions across the sleeve.

Figure 1:
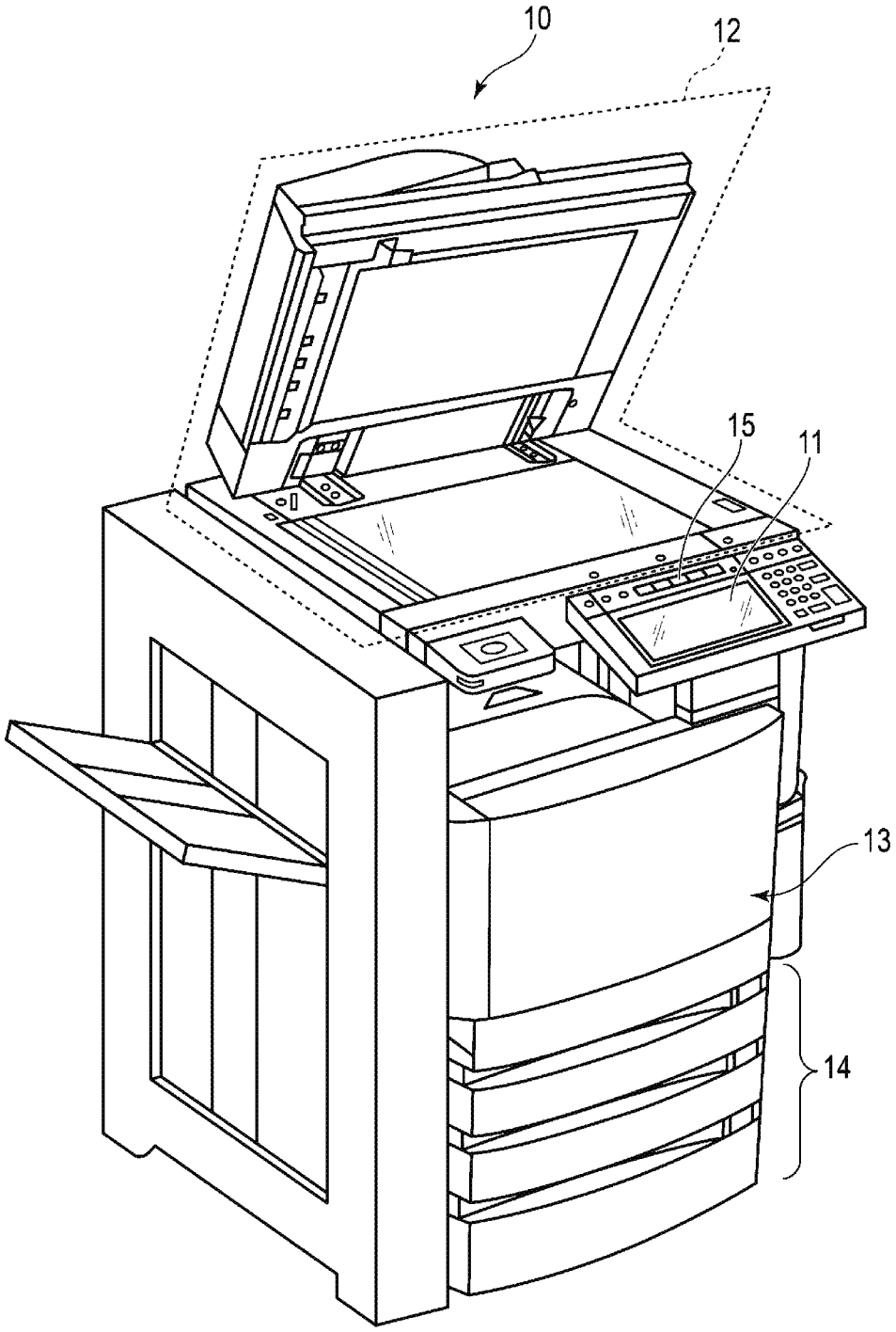
FIG. 1 is an appearance diagram illustrating an example of an image forming apparatus according to an embodiment.

Hereinafter, an image forming apparatus according to an embodiment will be described with reference to the drawings. FIG. 1 is an appearance diagram illustrating an example of an image forming apparatus 10 according to the embodiment.

The image forming apparatus 10 is, for example, multi-function peripheral (MFP). The image forming apparatus 10 includes a display unit 11, an image reading unit 12, an image forming unit 13, a sheet tray 14, and an operation unit 15.

The display unit 11 operates as an output interface to display characters or images. The display unit 11 operates as an input interface to receive an instruction from a user. For example, the display unit 11 is a touch panel type liquid crystal display.

For example, the image reading unit 12 is a color scanner. Examples of the color scanner include a contact image sensor (CIS) and a charge coupled device (CCD). The image reading unit 12 reads an image formed on paper or the like using a sensor to generate image data.

The image forming unit 13 forms an image on a sheet-shaped recording medium with toner based on the image data read by the image reading unit 12 or image data received from an external device. Hereinafter, the sheet-shaped recording medium will be referred to as "sheet". For example, the image formed on the sheet is an output image called a hard copy or a print-out.

The sheet tray 14 supplies a sheet to be used for outputting an image to the image forming unit 13.

Figure 2:
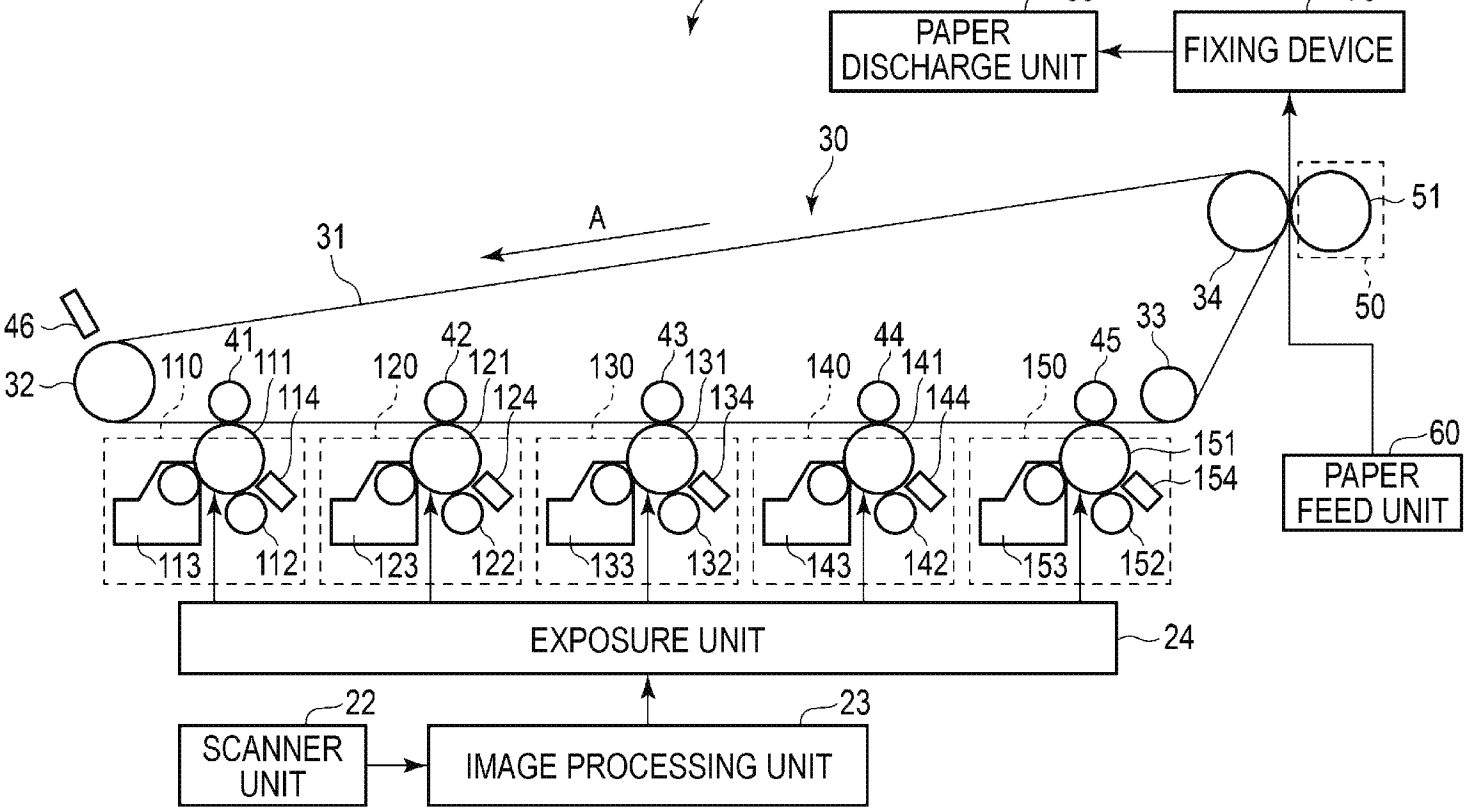
FIG. 2 is a diagram illustrating an example of a schematic configuration of the image forming apparatus according to the embodiment.

FIG. 2 is a diagram illustrating an example of a schematic configuration of the image forming apparatus 10 according to the embodiment. The image forming apparatus 10 is an electrophotographic image forming apparatus. The image forming apparatus 10 is a quintuple-tandem type image forming apparatus.

The image forming apparatus 10 includes a scanner unit 22, an image processing unit 23, an exposure unit 24, an intermediate transfer unit 30, a secondary transfer unit 50, a sheet feed unit 60, a fixing device 70, and a sheet discharge unit 80. The image forming apparatus 10 also includes electrophotographic process (EPU) units 110, 120, 130, 140, and 150. Although not illustrated, the image forming apparatus 10 includes a control unit that controls the respective units.

The scanner unit 22 reads the image formed on the sheet as a scanning target. For example, the scanner unit 22 reads the image on the sheet to generate image data of three primary colors including red (R), green (G), and blue (B). The scanner unit 22 outputs the generated image data to the image processing unit 23.

The image processing unit 23 converts the image data into color signals of colors. For example, the image processing unit 23 converts the image data into image data (color signals) of four colors including yellow (Y), magenta (M), cyan (C), and black (K). The image processing unit 23 controls the exposure unit 24 based on the color signals of the colors.

The exposure unit 24 irradiates the EPU units 110 to 150 with light. The exposure unit 24 includes a light source such as a laser or an LED.

The EPU units 110 to 150 form images to be transferred to the sheet. That is, the EPU units 110 to 150 are image forming units. The EPU units 110 to 150 form images using different toners.

The EPU unit 110 includes a photoconductive drum 111, a charging unit 112, a developing device 113, and a cleaner 114. Likewise, the EPU units 120, 130, 140, and 150 include photoconductive drums 121, 131, 141, and 151, charging units 122, 132, 142, and 152, developing devices 123, 133, 143, and 153, and cleaners 124, 134, 144, and 154, respectively.

Each of the photoconductive drums 111 to 151 is an image carrier on which a latent image is formed. Each of the photoconductive drums 111 to 151 includes a photoconductor on an outer circumferential surface. For example, the photoconductor is an organic photoconductor (OPC). The charging units 112 to 152 uniformly charge surfaces of the photoconductive drums 111 to 151, respectively. The photoconductive drums 111 to 151 that are uniformly charged are selectively irradiated with light from the exposure unit 24 to form electrostatic latent images. The developing devices 113 to 153 develop the electrostatic latent images formed on the photoconductive drums 111 to 151 with toners. The cleaners 114 to 154 remove the toners attached to the photoconductive drums 111 to 151.

The intermediate transfer unit 30 and the secondary transfer unit 50 work together to configure the transfer device that transfers the images formed by the EPU units 110 to 150 to a sheet supplied from the sheet feed unit 60.

The intermediate transfer unit 30 includes an intermediate transfer medium 31. The intermediate transfer medium 31 is an endless belt.

The intermediate transfer unit 30 also includes driving rollers 32, 33, and 34. The driving rollers 32 to 34 apply a tensile force to support the intermediate transfer medium 31. The driving rollers 32 to 34 revolves the intermediate transfer medium 31 in a direction of an arrow A.

The intermediate transfer unit 30 further includes primary transfer rollers 41, 42, 43, 44, and 45. The primary transfer rollers 41 to 45 face the EPU units 110 to 150 across the intermediate transfer medium 31, respectively. The primary transfer rollers 41 to 45 transfer the images formed with the toners by the EPU units 110 to 150 to the surface of the intermediate transfer medium 31, respectively.

The intermediate transfer unit 30 also includes a cleaner 46. The cleaner 46 removes toner attached to the intermediate transfer medium 31. For example, the cleaner 46 includes a plate-shaped cleaning blade. For example, the cleaning blade is formed of a resin such as a urethane resin.

The EPU units 110 to 140 form images using non-decolorable toners of four colors for color printing. The EPU unit 110 forms an image using yellow (Y) toner. The EPU unit 120 forms an image using magenta (M) toner. The EPU unit 130 forms an image using cyan (C) toner. The EPU unit 140 forms an image using black (K) toner.

On the other hand, the EPU unit 150 forms an image using decolorable toner. The decolorable toner has characteristics that it is decolored by an external stimulus. For example, the decolorable toner is decolored at a temperature higher than a certain temperature (decoloration temperature). As a result, the image formed by the decolorable toner is invisible. On the other hand, the non-decolorable toner does not have the characteristics. That is, the non-decolorable toner does not have characteristics that it is decolored by an external stimulus.

The EPU units 110 to 150 are installed in the revolving direction A of the intermediate transfer medium 31 in order of the EPU units 110, 120, 130, 140, and 150.

The secondary transfer unit 50 transfers the images formed with the toners on the intermediate transfer medium 31 to the sheet.

The secondary transfer unit 50 includes a secondary transfer roller 51. The secondary transfer roller 51 faces the driving roller 34 across the intermediate transfer medium 31. The secondary transfer roller 51 is in contact with the intermediate transfer medium 31 and is driven to rotate by the revolution of the intermediate transfer medium 31.

The sheet fed from the sheet feed unit 60 passes through a gap between the intermediate transfer medium 31 and the secondary transfer roller 51 along with the revolution of the intermediate transfer medium 31 and the rotation of the secondary transfer roller 51. During the passage of the sheet, the secondary transfer unit 50 transfers the images formed with the toners on the intermediate transfer medium 31 to the sheet.

For example, in order to deal with the sheet jam, the secondary transfer unit 50 is configured to become separable from the intermediate transfer medium 31.

The fixing device 70 fixes the toner images transferred to the sheet to the sheet by heating and pressurization. The sheet on which an image is formed by the fixing device 70 is discharged to the outside of the apparatus from the sheet discharge unit 80.

Next, the outline of the operation of the EPU units 110 to 150 will be described. The EPU units 110 to 150 have the same configuration except for the toners. Here, the EPU unit 110 will be described as a representative example, and the description of the other EPU units 120 to 150 will be omitted.

The photoconductive drum 111 is charged to a predetermined potential by the charging unit 122. Next, the photoconductive drum 111 is irradiated with light from the exposure unit 24. As a result, the potential of the region irradiated with light in the photoconductive drum 111 changes. Due to this change, an electrostatic latent image is formed on the surface of the photoconductive drum 111. The electrostatic latent image on the surface of the photoconductive drum 111 is developed by a developer of the developing device 113. That is, the image developed with the toner is formed on the surface of the photoconductive drum 111. Hereinafter, the image developed with the toner will be referred to as "developed image".

The developed images formed by the EPU units 110 to 150 are transferred to the sheet through a first transfer step and a second transfer step.

The first transfer step will be described. First, the primary transfer roller 41 facing the photoconductive drum 111 transfers the developed image on the photoconductive drum 111 to the intermediate transfer medium 31. Next, the primary transfer roller 42 facing the photoconductive drum 121 transfers the developed image on the photoconductive drum 121 to the intermediate transfer medium 31. Similarly, the primary transfer rollers 43, 44, and 45 also transfer the developed images on the photoconductive drums 131, 141, and 151 to the intermediate transfer medium 31, respectively.

At this time, the developed images on the photoconductive drums 111 to 151 are transferred to the intermediate transfer medium 31 so as to overlap each other. Therefore, on the intermediate transfer medium 31 that passed the EPU unit 150, the images developed with the respective color toners are overlapped and transferred.

However, when an image is formed using only the non-decolorable toners, the EPU units 110 to 140 operate. Through the above-described operations, the developed images of only the non-decolorable toners are formed on the intermediate transfer medium 31. In addition, when an image is formed using only the decolorable toner, the EPU units 150 operates. Through the above-described operations, the developed image of only the decolorable toner is formed on the intermediate transfer medium 31.

Next, the second transfer step will be described. A voltage is applied to the driving roller 34 of the intermediate transfer unit 30. Therefore, an electric field is generated between the driving roller 34 of the intermediate transfer unit 30 and the secondary transfer roller 51 of the secondary transfer unit 50. Due to this electric field, the secondary transfer unit 50 transfers the developed images formed on the intermediate transfer medium 31 to the sheet. Thereafter, the developed images transferred to the sheet are fixed by the fixing device 70.

Next, the kinds of image forming processes that are performed by the image forming apparatus 10 (refer to FIG. 1) according to the embodiment will be described. The image forming apparatus 10 executes printing in the following three modes.

Monochrome toner mode: an image is formed using non-decolorable single black toner.

Color toner mode: an image is formed using non-decolorable monochrome toner and color toners Decolorable toner mode: an image is formed only using decolorable toner.

The mode in which an image is formed can be selected in accordance with the operation of the user on the display unit 11 of the image forming apparatus 10.

In the monochrome toner mode, an image is formed by operating the image forming unit using non-decolorable black (K) toner. The monochrome toner mode is selected when the user wants to print a general monochrome image. For example, the monochrome toner mode is used when paper such as an important document is desired to be stored without being reused.

In the color toner mode, an image is formed by operating four image forming units using non-decolorable yellow (Y), magenta (M), cyan (C), and black (K) toners. The color toner mode is selected when the user wants to print a color image.

In the decolorable toner mode, an image is formed by operating only the image forming unit using decolorable toner. The decolorable toner mode is selected when paper on which an image is formed is reused.

The fixing device 70 operates in two modes including a fixing mode and a decoloration mode. In the fixing mode, the toner image transferred to the sheet is fixed to the sheet. In the decoloration mode, the image formed with the toner on the sheet is decolored from the sheet. In the decoloration mode, the fixing device 70 operates at a temperature higher than that in the fixing mode. The fixing device 70 switches between the fixing mode and the decoloration mode by an operation of the operation unit 15 (refer to FIG. 1).

Figure 3:
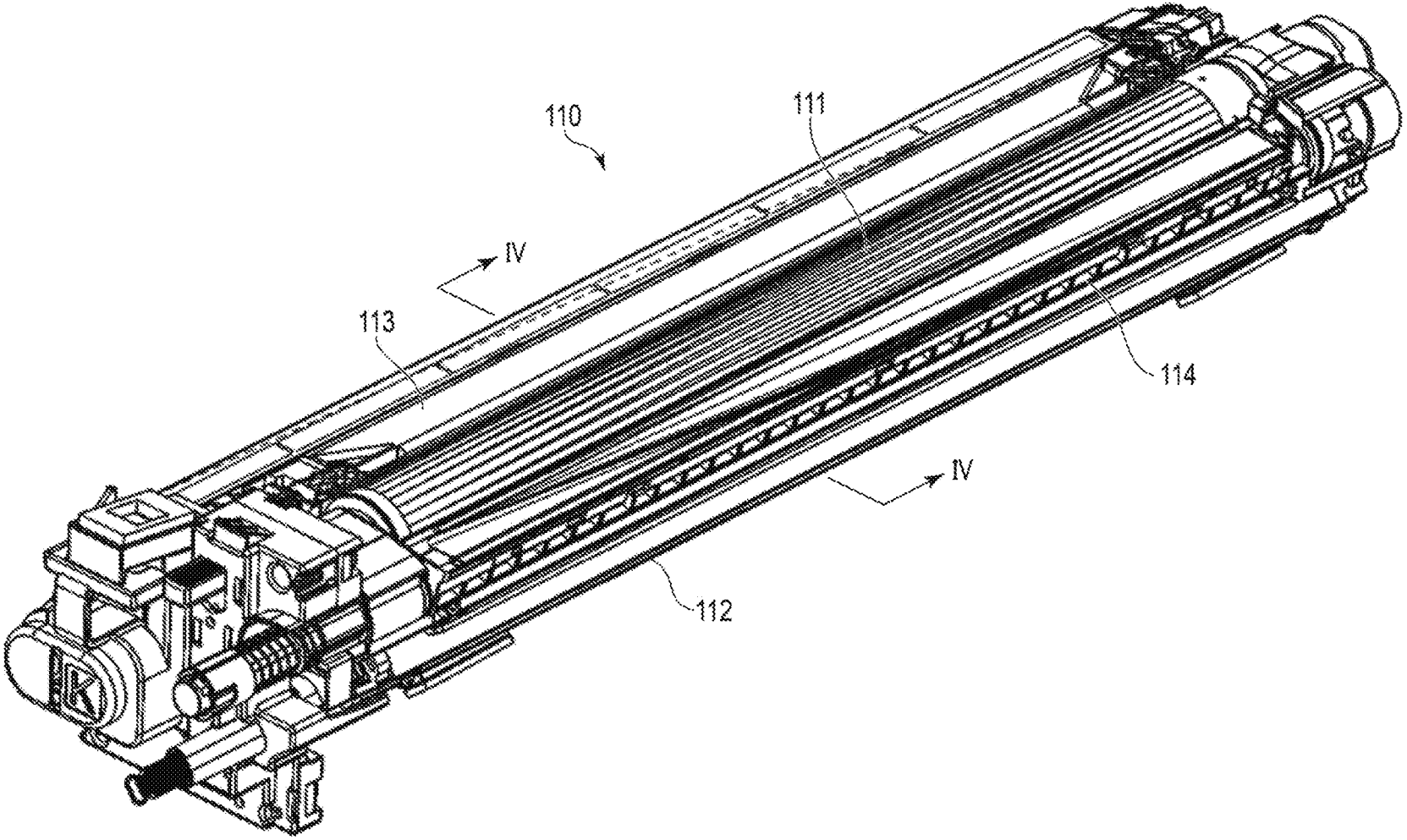
FIG. 3 is a perspective view illustrating an example of a schematic configuration of an EPU unit according to the embodiment.

Next, the EPU unit 110 will be described as a representative example with reference to FIG. 3. FIG. 3 is a perspective view showing the EPU unit 110.

As illustrated in FIG. 3, the EPU unit 110 includes the photoconductive drum 111, the charging unit 112, the developing device 113, and the cleaner 114. The photoconductive drum 111 has an elongated cylindrical external appearance. Accordingly, the charging unit 112, the developing device 113, and the cleaner 114 also have an elongated external appearance and extend along the photoconductive drum 111.

Figure 4:
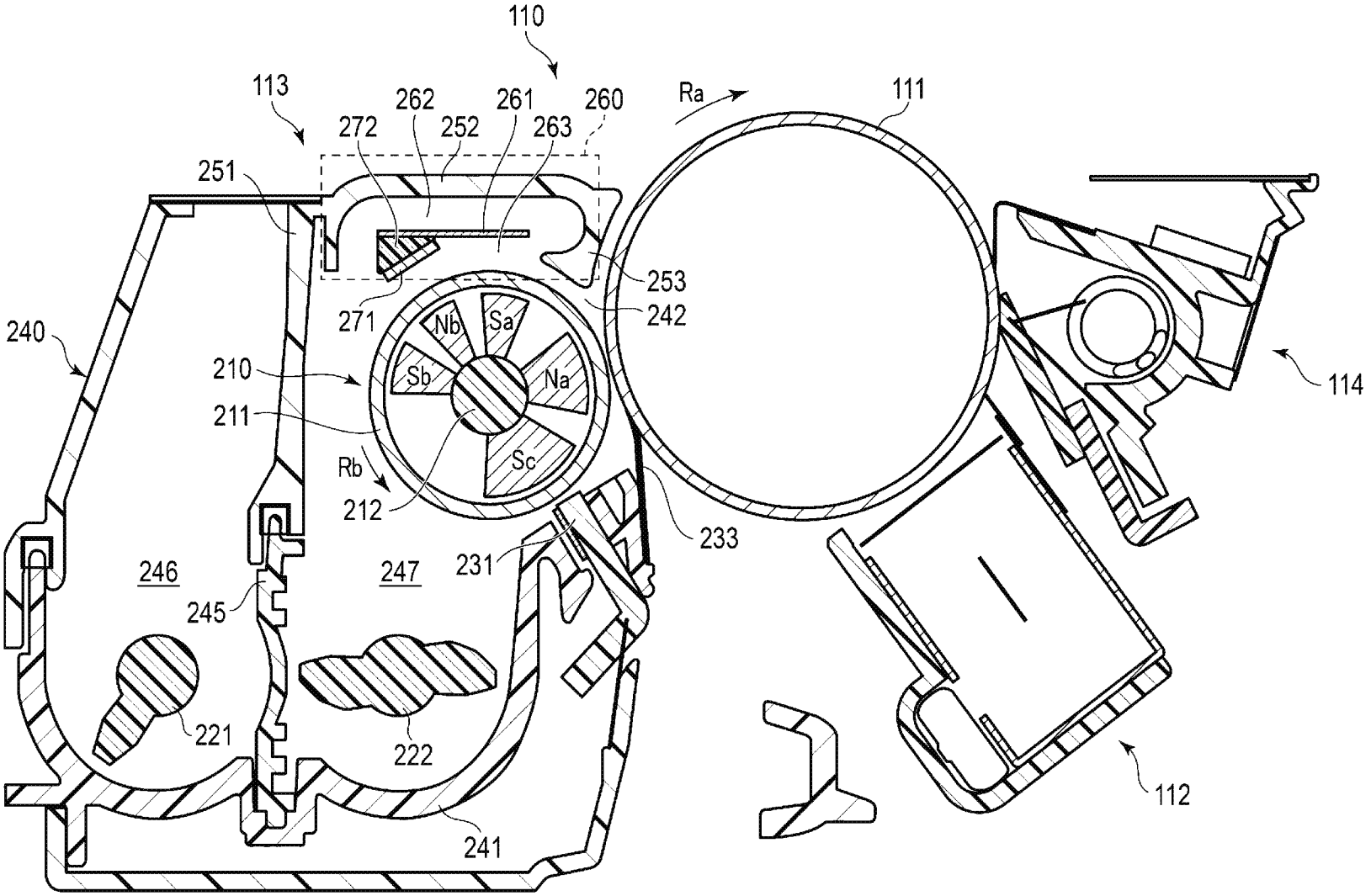
FIG. 4 is a cross-sectional view illustrating the EPU unit taken along line IV-IV of FIG. 3.
Figure 5:
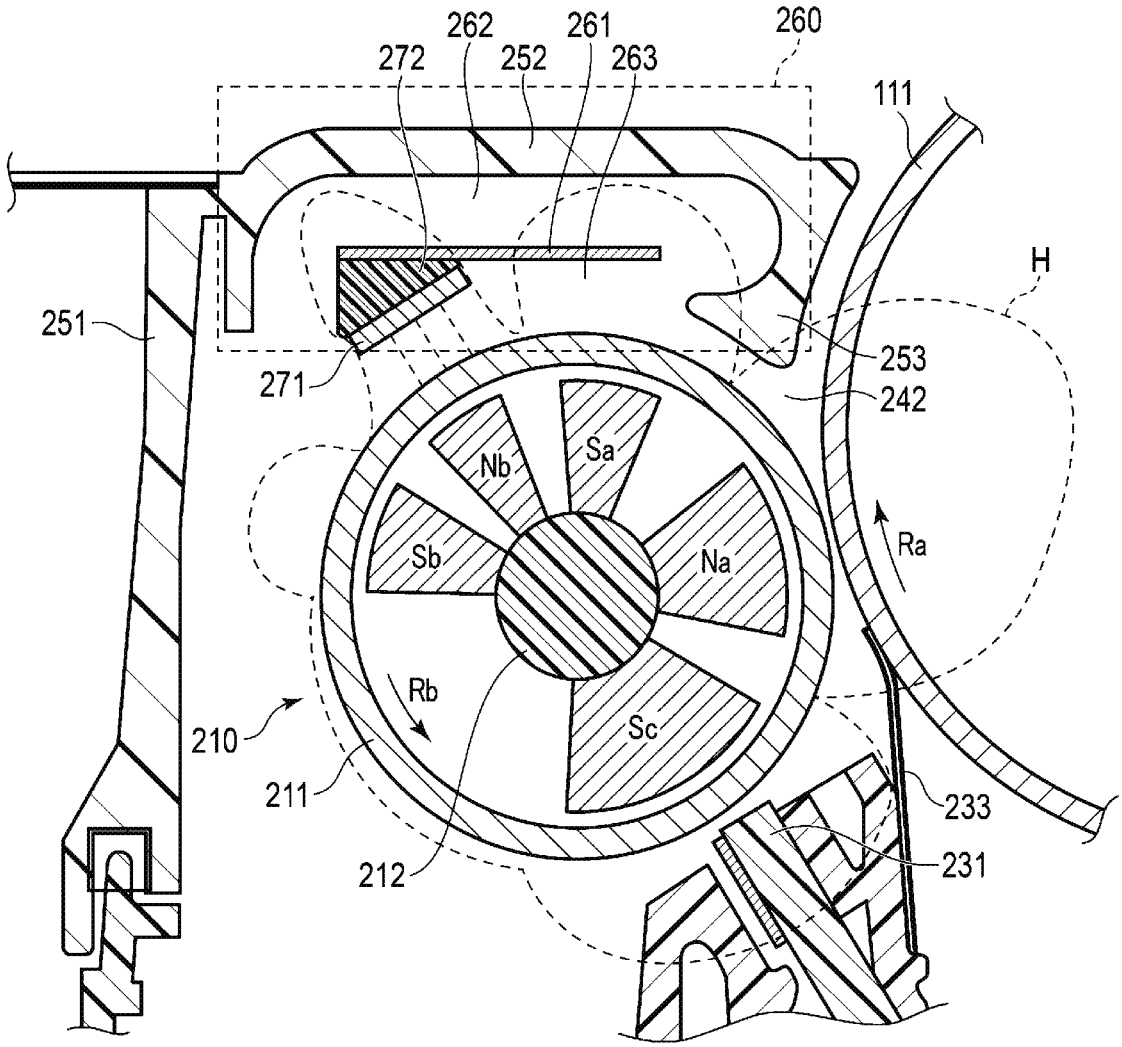
FIG. 5 is an enlarged view illustrating a peripheral portion of a developing roller illustrated in FIG. 4.

Next, the developing device 113 of the EPU unit 110 will be described in detail with reference to FIGS. 4 and 5. FIG. 4 is a cross-sectional view illustrating the EPU unit 110 taken along line IV-IV of FIG. 3. FIG. 5 is an enlarged view illustrating a peripheral portion of a developing roller 210 of the developing device 113.

As illustrated in FIG. 4, the developing device 113 includes the developing roller 210, a first mixer 221, a second mixer 222, and a developing case 240.

As can be seen from the external appearance of the developing device 113 shown in FIG. 3, all of the developing roller 210, the first mixer 221, the second mixer 222, and the developing case 240 have an elongated external appearance and extend in a direction perpendicular to the plane of FIG. 4. Hereinafter, for convenience of description, the direction or the axis perpendicular to the plane of FIG. 4 will be referred to as "longitudinal direction" or "major axis".

The developing case 240 accommodates the developing roller 210, the first mixer 221, and the second mixer 222. Although not illustrated, the developing case 240 also contains a developer. The developer contains toner as a colorant. The developer may be a one-component developer or a two-component developer. The two-component developer contains a carrier as a magnetic material and a non-magnetic toner. For example, the carrier is formed of iron powder or polymer ferrite particles having a particle size of several tens of micrometers.

The developing case 240 includes a case lower half 241 and a case upper half 251. The case lower half 241 and the case upper half 251 are joined to each other.

The developing case 240 includes a first chamber 246 and a second chamber 247. The first mixer 221 is disposed inside the first chamber 246. The second mixer 222 and the developing roller 210 are disposed inside the second chamber 247.

The first chamber 246 and the second chamber 247 are partitioned by a partition wall 245. The partition wall 245 is present at a center portion along the major axis but is not present at both end portions along the major axis. Accordingly, the first chamber 246 and the second chamber 247 are connected to each other at both end portions along the major axis.

The first mixer 221 and the second mixer 222 are disposed parallel to each other along the major axis. The first mixer 221 and the second mixer 222 are supported to be rotatable. Each of the first mixer 221 and the second mixer 222 includes a blade extending spirally along the major axis. The first mixer 221 and the second mixer 222 are rotated by a driving device (not illustrated). The first mixer 221 functions to stir the developer in the first chamber 246. The second mixer 222 functions to stir the developer in the second chamber 247 and diffuses the developer in the second chamber 247 to supply the developer to the developing roller 210.

As illustrated in FIG. 5 in detail, the developing case 240 includes an opening 242 through which a part of the developing roller 210 is exposed. The developing roller 210 is partially exposed through the opening 242. The developing roller 210 faces the photoconductive drum 111 through the opening 242 of the developing case 240. In other words, the part of the developing roller 210 exposed through the opening 242 faces the photoconductive drum 111.

The developing roller 210 includes a sleeve 211, a shaft 212, and a plurality of magnetic pole portions Na, Sa, Nb, Sb, and Sc. The sleeve 211, the shaft 212, and the plurality of magnetic pole portions Na, Sa, Nb, Sb, and Sc extend along the major axis.

The sleeve 211 has a cylindrical shape. The shaft 212, and the plurality of magnetic pole portions Na, Sa, Nb, Sb, and Sc are disposed inside the sleeve 211. Both end portions of the shaft 212 are fixed to the developing case 240. The sleeve 211 and the shaft 212 are disposed concentrically. The sleeve 211 is supported to be rotatable around a central axis of the shaft 212.

In the EPU unit 110, the photoconductive drum 111 is rotated in a direction of an arrow Ra. This rotation direction is a direction in which a moving direction of the photoconductive drum 111 and a moving direction of the intermediate transfer medium 31 are aligned in a contact portion between the photoconductive drum 111 and the intermediate transfer medium 31.

The sleeve 211 is rotated in a direction of an arrow Rb by a driving device (not illustrated) along with the rotation of the photoconductive drum 111. This rotation direction is a direction in which a moving direction of the sleeve 211 and a moving direction of the photoconductive drum 111 are aligned in a portion where the sleeve 211 and the photoconductive drum 111 face each other.

The magnetic pole portions Na, Sa, Nb, Sb, and Sc are fixed to the shaft 212. The magnetic pole portions Na, Sa, Nb, Sb, and Sc are disposed around the shaft 212 apart from each other. For example, each of the magnetic pole portions Na, Sa, Nb, Sb, and Sc is formed of a magnet. The magnetic pole portions Na, Sa, Nb, Sb, and Sc generate a magnetic field H.

The magnetic pole portion Na is disposed to face the photoconductive drum 111 across the sleeve 211. The magnetic pole portion Sc is disposed near the opening 242 of the developing case 240. The magnetic pole portions Na, Sa, Nb, Sb, and Sc are arranged in order in the direction of the arrow Rb, in other words, in the rotation direction of the sleeve 211. In the rotation direction of the sleeve 211, the magnetic pole portions Sa, Nb, and Sb are positioned downstream of the magnetic pole portion Na, and the magnetic pole portion Sc is positioned upstream of the magnetic pole portion Na. Here, the upstream and the downstream correspond to two portions into which the developing roller 210 is broadly divided based on the magnetic pole portion Na, respectively. The magnetic pole portion Na corresponds to the exposed portion of the developing roller 210.

The developing roller 210 is held on the surface of the sleeve 211 with a magnetic force of the magnetic pole portion Sc. The developer held on the surface of the sleeve 211 is transported by the rotation of the sleeve 211. In addition, the developer held on the surface of the sleeve 211 forms napping due to a magnetic force of the magnetic pole portions Na, Sa, Nb, Sb, and Sc. The toner in the developer napping formed due to magnetic force of the magnetic pole portion Na moves to the photoconductive drum 111 according to the electrostatic latent image formed on the photoconductive drum 111. As a result, the electrostatic latent image of the photoconductive drum 111 is developed. In addition, the developer that remains on the surface of the sleeve 211 without moving to the photoconductive drum 111 is released from the surface of the sleeve 211 due to the repulsion between the magnetic force of the magnetic pole portion Nb and the magnetic force of the magnetic pole portion Sb.

The developing case 240 includes a doctor blade 231 and a shield portion 233 near a lower portion of the opening 242.

The doctor blade 231 has an elongated plate shape and extends along the major axis. A tip of the doctor blade 231 is separated from the surface of the sleeve 211 of the developing roller 210 at a predetermined interval. The doctor blade 231 restricts the thickness of the developer held on the surface of the sleeve 211 of the developing roller 210.

The shield portion 233 is disposed between the doctor blade 231 and the photoconductive drum 111. The shield portion 233 extends along the major axis. A tip portion of the shield portion 233 is in contact with the photoconductive drum 111. That is, the shield portion 233 closes a gap between the developing case 240 and the photoconductive drum 111. As a result, the shield portion 233 blocks the flow of air from the developing device 113 to the photoconductive drum 111.

The developing case 240 includes a circulation path 260. The air containing the toner diffused in the second chamber 247 passes through the circulation path 260 and circulates between a top portion 252 of the case upper half 251 and the developing roller 210. The circulation path 260 includes an upper path 262 and a lower path 263. The upper path 262 and the lower path 263 extend parallel to each other. One end portion of the upper path 262 and one end portion of the lower path 263 are connected to each other. The lower path 263 is adjacent to the developing roller 210.

Therefore, the developing case 240 includes a path forming member 261. The path forming member 261 is disposed between the top portion 252 of the case upper half 251 and the developing roller 210. The path forming member 261 has an elongated plate shape and extends along the major axis. The path forming member 261 and the top portion 252 work together to form the upper path 262. The path forming member 261 and the developing roller 210 also work together to form the lower path 263.

The developing case 240 includes a guide portion 253 at an upper position of the opening 242. The guide portion 253 guides the air flowing through the upper path 262 to the lower path 263.

The developing case 240 includes a magnet 271. The magnet 271 has an elongated plate shape and extends along the major axis. The magnet 271 is fixed to the path forming member 261 through a support portion 272. Specifically, the magnet 271 is fixed to an end portion of the path forming member 261 on a side distant from the opening 242 of the developing case 240.

The magnet 271 faces the developing roller 210 and is disposed apart from the developing roller 210. That is, the magnet 271 is disposed inside the lower path 263.

The magnet 271 faces the magnetic pole portion Nb across the sleeve 211. The magnet 271 has S polarity. That is, the magnet 271 and the magnetic pole portion Nb each have a magnetic pole having a polarity opposite to each other.

The support portion 272 holds the magnet 271 in a state where the magnet 271 is tilted with respect to the path forming member 261. For example, the magnet 271 is disposed such that a normal line to a surface facing the developing roller 210 passes through a central axis of the developing roller 210. Further, the magnet 271 is disposed such that a normal line to the surface facing the developing roller 210 that passes through the center of the magnet 271 passes through the central axis of the developing roller 210.

Next, the flow of air in a peripheral portion of the developing roller 210 will be described with reference to FIG. 6.

Figure 6:
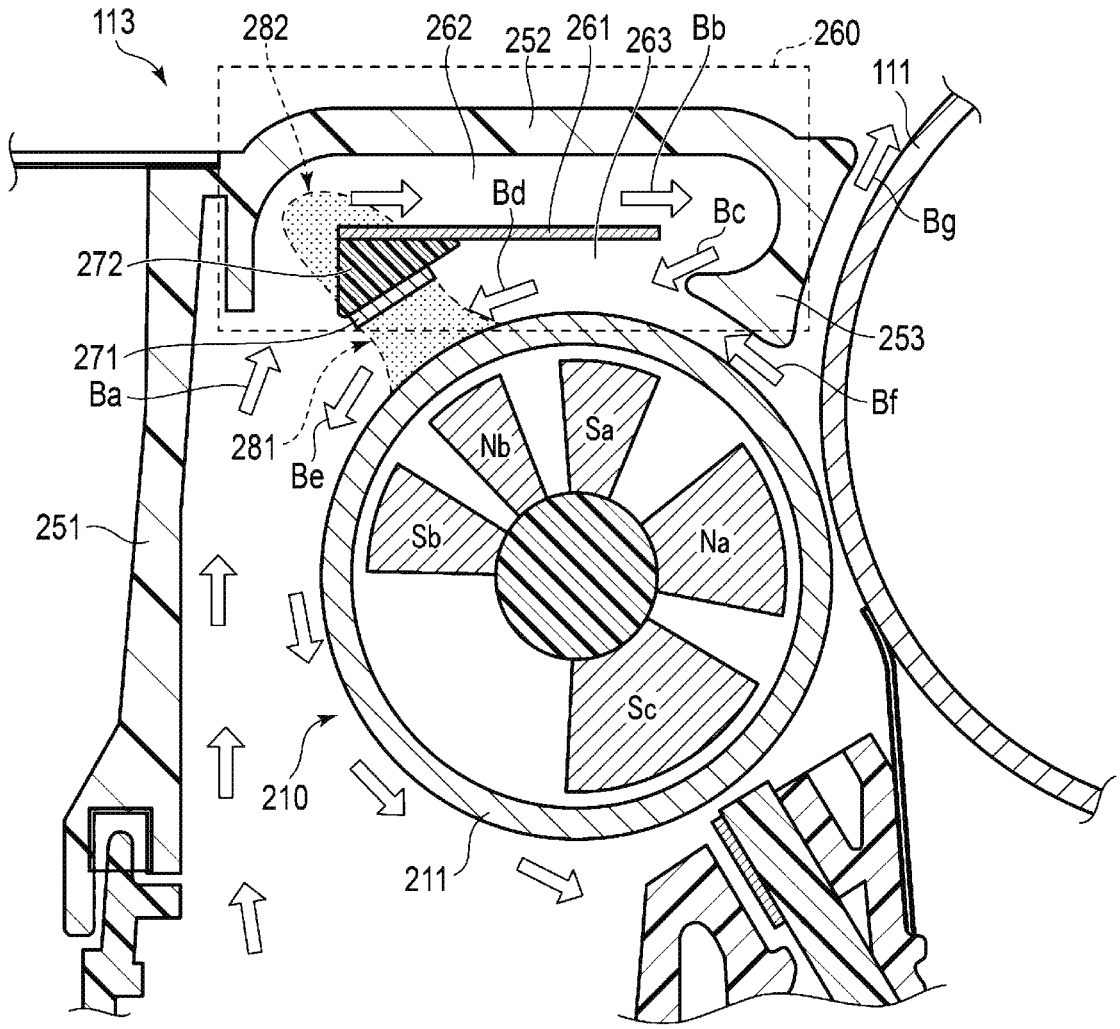
FIG. 6 is a diagram illustrating the flow of air in the peripheral portion of the developing roller illustrated in FIG. 5.

As illustrated in FIG. 6, the air containing the toner diffused in the second chamber 247 circulates and flows through the circulation path 260. Specifically, as indicated by an arrow Ba, the air containing the toner enters the upper path 262 from the side of the end portion of the path forming member 261 to which the magnet 271 is fixed. The air that entered the upper path 262 travels in the upper path 262 as indicated by an arrow Bb and is then guided to the lower path 263 by the guide portion 253 of the developing case 240 as indicated by an arrow Bc. The air guided to the lower path 263 passes through a gap between the magnet 271 and the developing roller 210 as indicated by an arrow Bd and flows out from the lower path 263. The air that flows out from the lower path 263 flows along the developing roller 210 as indicated by an arrow Be.

In addition, a part of the air between the developing device 113 and the photoconductive drum 111 flows along the developing roller 210 as indicated by an arrow Bf and enters the lower path 263. In addition, a part of the air flows through a gap between the developing device 113 and the photoconductive drum 111 as indicated by an arrow Bg.

The air that flows through the gap between the developing device 113 and the photoconductive drum 111 partially contains air that flows out from the developing device 113. The air that flows out from the developing device 113 contains, for example, air that travels in a direction opposite to the direction of the arrow Bf.

The toner in the air that flows out from the developing device 113 contaminates the inside of the image forming apparatus 10. Therefore, it is desirable that the air that flows out from the developing device 113 is suppressed as much as possible.

As described above, the developing device 113 includes the magnet 271 fixed to the path forming member 261. Therefore, in a downstream side end portion of the lower path 263, developer napping 281 is formed by a magnetic force of the magnet 271 and a magnetic force of the magnetic pole portion Nb of the developing roller 210. In addition, in an upstream side end portion of the upper path 262, developer napping 282 is formed by a magnetic force of the magnet 271.

Here, the upstream side and the downstream side are determined based on the flow of air. That is, the downstream side end portion of the lower path 263 and the upstream side end portion of the upper path 262 are end portions on the side where the magnet 271 is positioned.

The magnet 271 and the magnetic pole portion Nb each have a magnetic pole having a polarity opposite to each other. That is, a strong magnetic force acts between the magnet 271 and the developing roller 210. As a result, the strong developer napping 281 is formed in the downstream side end portion of the lower path 263. Here, the strong developer napping 281 represents that the developer napping spreads almost without gaps.

In the above description of the flow of air that circulates the circulation path 260, most part of the flow of air is representatively described. That is, air may also flow in a way different from that described above. For example, air may flow along the developing roller 210 in a direction opposite to the direction of the arrow Be.

This flow of air disturbs the flow of air in the lower path 263 when entering the lower path 263. Undesirably, the disturbance of the flow of air in the lower path 263 intensifies the air that flows out from the developing device 113. This disturbance promotes the toner to contaminate the inside of the image forming apparatus 10.

However, the developing device 113 according to the embodiment includes the magnet 271, and the magnet 271 forms the developer napping 281 between the magnet 271 and the developing roller 210. Therefore, the flow of air in the direction opposite to the direction of the arrow Be is blocked by the developer napping 281. As a result, the disturbance of the flow of air in the lower path 263 caused by the reverse flow is prevented. As a result, the amount of air that flows out from the developing device 113 is reduced.

In addition, in the upstream side end portion of the upper path 262, developer napping 282 is formed by a magnetic force of the magnet 271. Therefore, the toner in the air that entered the upper path 262 is absorbed by the developer napping 282. As a result, the amount of the toner in the air that entered the upper path 262 is reduced. Thus, of course, the amount of the toner in the air that flows out from the developing device 113 is reduced.

This way, in the developing device 113 according to the embodiment, the amount of air that flows out from the developing device 113 is reduced, and the amount of the toner in the air that flows out from the developing device 113 is reduced. As a result, the contamination of the inside of the image forming apparatus 10 caused by the toner is effectively prevented.

Figure 7:
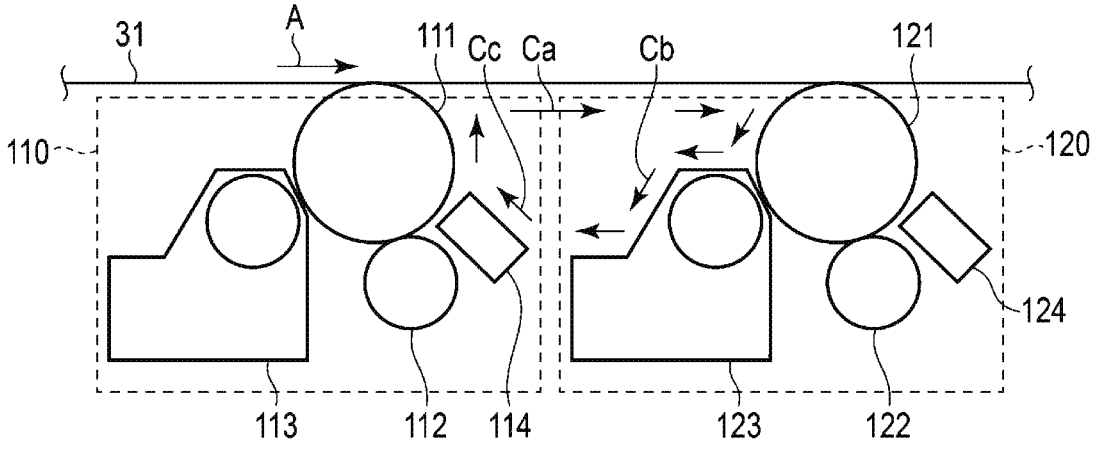
FIG. 7 is a side view illustrating the flow of air between two EPU units adjacent to each other.

Next, the flow of air between two EPU units adjacent to each other will be described with reference to FIG. 7. FIG. 7 illustrates the flow of air between the EPU unit 110 and the EPU unit 120.

As illustrated in FIG. 7, in a peripheral portion of the intermediate transfer medium 31 between the EPU unit 110 and the EPU unit 120, as indicated by an arrow Ca, air flows in a moving direction of the intermediate transfer medium 31, that is, in a direction of an arrow A along with the movement of the intermediate transfer medium 31.

In a peripheral portion of the EPU unit 120, the air that flows along the intermediate transfer medium 31 is blocked by the intermediate transfer medium 31 and the photoconductive drum 121 such that the direction of the flow changes. Next, as indicated by an arrow Cb, the air flows toward the EPU unit 110 along the developing device 123.

In a peripheral portion of the EPU unit 110, as indicated by an arrow Cc, the air that flows toward the EPU unit 110 changes the direction of the flow due to the cleaner 114 to flow along the photoconductive drum 111. Next, the air changes the direction of the flow due to the intermediate transfer medium 31 to flow along the intermediate transfer medium 31 as described above.

That is, in the region between the two EPU units 110 and 120 adjacent to each other, air circulates in a space surrounded by the EPU units 110 and 120 and the intermediate transfer medium 31. Therefore, the toner in the air that flows out from the developing device 123 of the EPU unit 120 causes the contamination of the EPU unit 110 adjacent to the EPU unit 120.

The developing device 123 of the EPU unit 120 includes the magnet 271 as in the developing device 113 of the EPU unit 110 described above as the representative example. Therefore, the amount of the toner in the air that flows out from the developing device 123 is also small. Therefore, the EPU unit 110 adjacent to the EPU unit 120 is effectively prevented from being contaminated by the toner.

In addition, as illustrated in FIG. 2, the EPU units 110 to 150 are disposed along the intermediate transfer medium 31. In the moving direction of the intermediate transfer medium 31, the EPU unit 110 is positioned on the most upstream side, and the EPU unit 150 is positioned on the most downstream side. Therefore, the flow of air described above with reference to FIG. 7 is present between the EPU units 110 to 140 and the EPU units 120 to 150 positioned on the downstream side thereof.

However, the EPU unit 110 is positioned on the most upstream side, and another EPU unit is not present on the upstream side of the EPU unit 110. Therefore, there is no concern that the toner in the air that flows out from the developing device 113 of the EPU unit 110 contaminates another EPU unit. Therefore, the magnet 271 may be omitted in the developing device 113 of the EPU unit 110.

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. A developing device configured to develop a latent image formed on an image carrier with toner, the developing device comprising:

a developing case containing the toner and including a circulation path through which air containing the toner flows;

a mixer accommodated in the developing case and configured to stir the toner to diffuse the toner in the developing case;

a developing roller partially exposed from the developing case, accommodated in the developing case, including a sleeve rotating along with movement of the image carrier and a plurality of magnetic pole portions disposed inside the sleeve, and configured to hold the toner on the sleeve, supply the toner to the image carrier, and develop the latent image; and a magnet disposed apart from the developing roller and facing one of the magnetic pole portions across the sleeve.

2. The developing device according to claim 1, wherein the magnet is disposed in the circulation path.

3. The developing device according to claim 2, wherein the circulation path includes a first path and a second path, one end portion of the first path and one end portion of the second path are connected to each other, the second path is adjacent to the developing roller, and the magnet is disposed in the second path.

4. The developing device according to claim 3, wherein the developing case includes a path forming member that forms the first path and the second path, and the magnet is fixed to the path forming member.

5. The developing device according to claim 4, wherein the magnet is disposed such that a normal line to a surface facing the developing roller passes through a central axis of the developing roller.

6. The developing device according to claim 1, wherein the magnet and the magnetic pole portion facing the magnet each have a magnetic pole having a polarity opposite to each other.

7. The developing device according to claim 6, wherein the magnet has S polarity and the magnetic pole portion facing the magnet has N polarity.

8. The developing device according to claim 7, wherein the magnetic pole portion facing the magnet is positioned downstream of an exposed portion of the developing roller in a rotation direction of the sleeve.

9. The developing device according to claim 1, wherein the magnet extends along a major axis of the developing roller.

10. An image forming apparatus configured to form an image on a recording medium, the image forming apparatus comprising:

an image carrier on which a latent image is formed;

a developing device configured to develop the latent image formed on the image carrier with toner; and a transfer device configured to transfer the image developed by the developing device to a recording medium, wherein the developing device comprises:

a developing case containing the toner and including a circulation path through which air containing the toner flows;

a mixer accommodated in the developing case and configured to stir the toner to diffuse the toner in the developing case;

a developing roller partially exposed from the developing case, accommodated in the developing case, including a sleeve rotating along with the movement of the image carrier and a plurality of magnetic pole portions disposed inside the sleeve, and configured to hold the toner on the sleeve, supply the toner to the image carrier, and develop the latent image; and a magnet disposed apart from the developing roller and facing one of the magnetic pole portions across the sleeve.

11. The image forming apparatus according to claim 10, wherein the magnet is disposed in the circulation path.

12. The image forming apparatus according to claim 11, wherein the circulation path includes a first path and a second path, one end portion of the first path and one end portion of the second path are connected to each other, the second path is adjacent to the developing roller, and the magnet is disposed in the second path.

13. The image forming apparatus according to claim 12, wherein the developing case includes a path forming member that forms the first path and the second path, and the magnet is fixed to the path forming member.

14. The image forming apparatus according to claim 13, wherein the magnet is disposed such that a normal line to a surface facing the developing roller passes through a central axis of the developing roller.

15. The image forming apparatus according to claim 10, wherein the magnet and the magnetic pole portion facing the magnet each have a magnetic pole having a polarity opposite to each other.

16. The image forming apparatus according to claim 15, wherein the magnet has S polarity and the magnetic pole portion facing the magnet has N polarity.

17. The image forming apparatus according to claim 16, wherein the magnetic pole portion facing the magnet is positioned downstream of an exposed portion of the developing roller in a rotation direction of the sleeve.

18. The image forming apparatus according to claim 10, wherein the magnet extends along a major axis of the developing roller.

19. A method of processing toner, comprising:

stirring the toner to diffuse the toner in a circulation path in a developing case of a developing device, the developing device comprising a developing roller partially exposed from the developing case;

rotating a sleeve along with movement of an image carrier, the sleeve comprising a plurality of magnetic pole portions inside;

holding the toner on the sleeve;

supplying the toner to the image carrier;

developing the latent image formed on the image carrier with toner; and disposing a magnet in the circulation path apart from the developing roller and facing one of the magnetic pole portions across the sleeve.

* * * * *